United States Patent [19]

Marián et al.

[11] Patent Number: 4,636,361

[45] Date of Patent: Jan. 13, 1987

[54] DEVICE FOR SEPARATING LIQUID FRACTIONS

[76] Inventors: Miklós Marián, 2 Eötvös St., Budapest H-1067, Hungary; Donald L. Weber, 6 Paul Place Ct., Florissant, Mo. 63031

[21] Appl. No.: 798,952

[22] Filed: Nov. 18, 1985

[51] Int. Cl.[4] ..... B01L 3/14; B04B 5/02

[52] U.S. Cl. ..... 422/101; 210/781; 210/515; 210/518; 210/927; 422/72; 494/16

[58] Field of Search ..... 422/72, 101; 494/16–20; 210/781, 782, 515, 518, 927

[56] References Cited

U.S. PATENT DOCUMENTS

| | | | |
|---|---|---|---|
| 2,136,170 | 11/1938 | Lubertzing | 422/101 |
| 3,300,051 | 1/1967 | Mitchell | 494/16 |
| 3,750,645 | 8/1973 | Bennett | 422/101 |
| 3,865,548 | 2/1975 | Padawar | 422/68 |
| 4,511,349 | 4/1985 | Nielsen | 422/101 |
| 4,557,902 | 12/1985 | Mussmann | 422/101 |

FOREIGN PATENT DOCUMENTS

| | | | |
|---|---|---|---|
| 871263 | 5/1971 | Canada | 494/16 |

*Primary Examiner*—Ernest G. Therkorn

[57] ABSTRACT

The invention relates to a device and process for separating selected fractions of liquids, preferably the fractions arising in density gradient centrifugation. Said device is characterized by a functional element, which is a space-enclosing element, its surface being partly formed by a net through which the free streaming of materials can occur in a liquid medium, the structure of the net ensuring that the liquid fraction entrapped in the space of the element is removable from the liquid medium by removing the element itself. For the purpose of density gradient centrifugation, a plurality of said functional elements are placed in a centrifuge tube, and after centrifugation, the specific fractions of the liquid entrapped in the inner spaces of the functional elements are separated by removing said functional elements one by one from the common housing tube.

2 Claims, 4 Drawing Figures

DEVICE FOR SEPARATING LIQUID FRACTIONS

BACKGROUND OF THE INVENTION

The present invention relates to a device for separating selected fractions of liquids, with particular regard to the fractions arising in density gradient centrifugation.

In the process of density gradient centrifugation, a density gradient of the liquid is formed and the various materials are localized in distinct layers of the liquid. After centrifugation, the gradient should be fractionated, for which purpose different techniques are used. A generally applied method, for example, is to collect the fractions from the top or bottom of the tube by suctioning off the liquid layer. For detailed discussion of the fractionation techniques, see the literature: "Preparative density centrifugation", Beckman Instrument International S.A., Geneva /1975/, Fritsch. A.

The known techniques of gradient fractionation can only partially satisfy the ideal requirement that the layers of liquid fractions be separated in thin, horizontal layers that do not undergo mixing during the separation process, and the further requirement that the process be quick enough for routine laboratory work in large series.

A new technique has recently been published in which gradient fractionation is carried out in a multichamber ultraeentrifuge tube. This tube is made from plastic material, and the chambers of the tube are joined by a constricted area which permits fluid communication between the chambers. Subsequent to centrifugation, the chambers can be sealed from each other to retain the separated fractions of the liquid. /See: PCT patent application, PCT International Publication Number WO 84/00313, priority U.S. application Ser. No. 395,371, now U.S. Pat. No. 4,511,349.

In spite of the present developments, further progress in this field is desirable as the gradient centrifugation technique is an important, widely used laboratory method. As examples, this method nowadays finds important application in medical diagnosis, serum lipoproteins can be separated and charactertized by density gradient centrifugation, and by measuring the quantities of cholesterol in the separated lipoprotein fractions, valuable information can be obtained with respect to prediction of the risk of coronary heart disease.

SUMMARY OF THE INVENTION

It is an object of the invention to provide a device comprising a plurality of functional elements in a centrifuge tube, which can be used for fractionating the fluid in the process of density gradient centrifugation in a simple way and with high resolving capacity.

The basic idea of the invention traces back to the principle that if the surface of a liquid is covered by a net having a suitable structure then, as a result of the combined actions of adhesion, cohesion and surface tension, the net will be able to maintain a liquid column of a certain height against gravitation.

For fractionation of the liquid in a centrifuge tube, a functional element is used, the lateral wall of which fits the wall of the tube. Accordingly, the lateral wall of said element has the form of a hollow cylinder in regular centrifuge tubes—while the upper and/or lower surfaces of said element comprise a net. The structure and the material of the net are such that it allows free streaming of the materials in the liquid medium through the net, but when said element is taken out from the liquid, the quantity of liquid entrapped in the inner space of the element remains in it and can only be removed by a direct intervention.

For formation of a device with which the density gradient centrifugation procedure can be carried out in accordance with the present invention, a plurality of said functional elements are placed over one another in the centrifuge tube, where said elements can contact directly or can be separated by a spacer element—said spacer element having the form of a ring in a regular cylindrical tube-, by this means a structure being formed which allows free motion of the materials in the liquid medium through the entire length of the tube, said structure, however, potentially fractionating the liquid according to the localization of said functional elements. After the performance of density gradient centrifugation, each said element encloses a portion of the liquid, the volume of which is determined by the size of the element, the characteristic material composition of said portion depending on the density value at which the given element is localized.

For separation of said liquid fractions, the functional elements should be taken out from the tube. This can be achieved, for example, by opening the side-wall of the tube or by removal of the bottom of the tube. The liquid contents can be removed from the elements by any simple means.

The invented device can be applied for separating liquid fractions in all cases where fractionation occurs in a liquid as a consequence of any force. Liquid fractionation can be produced not only on the action of a centrifugal force as stated above, but also in response to the gravitational force of the Earth, electrophoretic effects, and other effects. The consistency of the liquid applied in the invented device can vary in a wide range, and in special cases the medium can be in the state of a sol or gel.

DETAILED DESCRIPTION OF THE INVENTION

Figure 1:
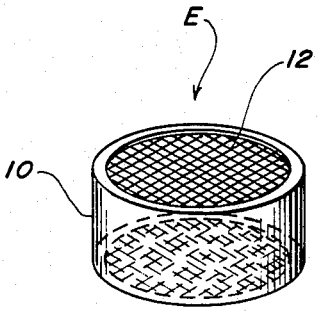
FIG. 1 is a perspective view of a functional element having a cylindrical shape and including net surfaces.
Figure 2:
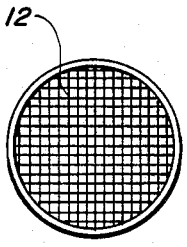
FIG. 2 is top and/or bottom view of a net surface of a cylindrical functional element.

FIG. 1 shows the essential functional element E of the invented liquid fractionating device, which is a cylindriform element if the fractionation is carried out in a regular centrifuge tube having a cylindrical side wall. It is a characteristic feature of the functional element E that the side-wall of the element is a cylinder jacket 10 of a hollow cylinder, while its upper and lower surfaces are formed by plane nets 12 /see FIG. 1 and 2/.

The chemical natures of the materials of the cylinder and the net can be the same or different; preferably, it is a plastic material having a density similar to the density of the liquid medium, said material being chemically indifferent and not absorbing components of the sample examined. The net is preferably made from thin fibers; its structure and the size of the mesh can be chosen as required. The net can be simple or multiple, that is one or more plane nets can be situated above each other; in the latter case the direction of the fibers in neighboring nets can be angled, or the net can be formed by weaving the fibers and by this means a three-dimensional structure being formed. The plane of the net is preferably perpendicular to the cylinder.

The height of the cylinder can be chosen in accordance with the thickness of the liquid layer to be separated, the largest value of the height being limited by the capability of the net to retain a liquid column. The material and the thickness of the cylinder should be chosen so that it is strong enough to ensure the tension of the net and the rigidity of the element during subsequent manipulation.

The net 12 can be attached to the cylinder jacket 10 by firm fixation or by separable means using any known technique. Firm fixation can be achieved, for example, by sticking or by soldering the plastic material via heat treatment.

Figure 3:
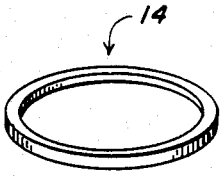
FIG. 3 is a perspective view of a spacer element.

In the invented fractionating device the cylindrical functional elements E1, E2, E3, etc. are situated directly on each other, or a distance is formed between adjacent elements by applying a spacer 14 /see FIG. 3/, which preferably has the same chemical nature, form and wall thickness as the cylinder, but is not supplied with a net and forms an open structure.

Figure 4:
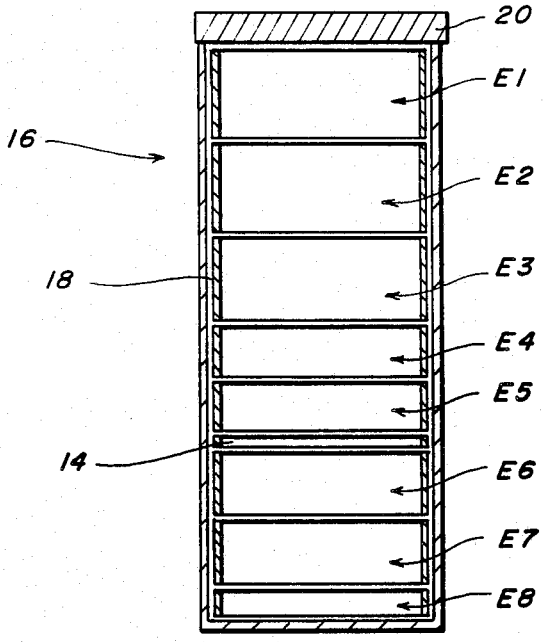
FIG. 4 is an elevation sectional view of a centrifuge tube containing the functional and spacer elements according to the invention.

Said functional elements E1–8 and spacer 14 are placed in a centrifuge tube 16 as shown in FIG. 4. Any type of centrifuge tube—as regards its form, material, largeness, etc.—can be used as an outer tube of the invented device; preferably, a regular cylindrical ultracentrifuge tube is used, which can have a hemispherical or plane bottom, the wall of the tube being easy to open in the final manipulation step. The interspace 18 between the wall of the centrifuge tube 16 and the cylinder jackets of the functional elements E1–8 is preferably as small as possible. The centrifuge tube is generally closed by applying any known capping means 20.

The number of the functional elements E as well as the spacers 14 used in the centrifuge tube is not limited, it is determined primarily by the number of the fractions to be separated in a certain case.

The functional element, having any geometric form, such as cylindrical, cubic, spherical, etc., can be used as an independent single device for taking out from a liquid a sample in a volume determined by the space of the element. For this purpose, said element can be supplied with a handle for facilitating the manipulation, said device can serve as a practical means for routine laboratory work.

The chemical nature of the materials of the functional and spacer elements can be the same or different; this is preferably a plastic material, a homopolymer or copolymer, such as polypropylene, polyethylene or ethylene-propylene copolymer.

Application of the invented device for accomplishing density gradient centrifugation and liquid fractionation is presented in the example as follows.

EXAMPLE 1

Said functional cylindrical element E and/or spacer elements 14 are placed in the ultracentrifuge tube 16, which is a regular plastic tube. The heights of the functional cylindrical elements are chosen so that they entrap the fractions which are expected to be localized at defined places in the tube during the density gradient centrifugation. The functional elements E and the spacers 14 should have fixed positions in the tube, which can preferably be attained simply by applying capping means 20 at the open end of the tube.

Gradient formation and placing of the sample in the tube supplied with said elements of the invention are carried out with the same techniques as used in the regular centrifuge tube; continuous or discontinuous gradient formation can be accomplished, and the sample fluid itself can also serve as fractionating medium, as is the case in the process of serum fractionation. Centrifugation of the tubes can be achieved in any type of centrifuge rotor used for this purpose.

After centrifugation, the functional cylindrical elements E are set free. This can be accomplished either by opening the wall of the centrifuge tube lengthwise, or by opening the bottom of the tube, removing the capping means 20 and pushing the cylindrical elements out of the tube. Each functional element retains the liquid fraction entrapped in its space, and the liquid can be removed by any simple technique such as a knock, suction, diffusion into a liquid medium, or any other means.

EXAMPLE 2

The form and final placement of the elements in the centrifuge tube 16 are the same as in Example 1. The gradient formation is accomplished in such a way, however, that each cylindrical functional element E is first filled with a fluid having a chosen density, said filled elements then being placed into the centrifuge tube so that the density values of the elements progressively decrease up to the top of the tube. The empty spaces between the elements will be filled with the liquid of the corresponding element. With a choice of the densities of the liquid fractions, the required fractions of the sample will be localized in specific functional elements. In this way a quick and simple fractionation of the sample can be achieved.

The invented device and the process applied have the advantage that by this means a simple and quick technique is available for density gradient fractionation, which is of great value for routine laboratory work.

What is claimed is:

1. A device for separating selected fractions of liquids in the process of density gradient centrifugation, said device comprising:

a functional element, the surface of which is formed partly by a net through which the free streaming of the materials in a liquid medium can occur and partly by a continuous surface, the continuous and net surface parts of said element enclosing a space, the net having a structure which ensures that the liquid fraction entrapped in the space of the element is removable from the liquid medium by removing the element itself, and a plurality of said functional elements being placed above each other in a centrifuge tube so that their net surfaces, being parallel to each other, are facing each other, said net surfaces either contacting each other or being separated by a space by application of a spacer element.

2. A process for separating liquid fractions in density gradient centrifugation, using a device comprising a functional element, the surface of which is formed partly by a net through which the free streaming of the materials in a liquid medium can occur and partly by a continuous surface, the continuous and net surface parts of said element enclosing a space, the net having a structure which ensures that the liquid fraction entrapped in the space of the element is removable from the liquid medium by removing the element itself and a plurality of said functional elements being placed above each other in a centrifuge tube so that their net surfaces, being parallel to each other, are facing each other, said net surfaces either contacting each other or being separated by a spaced by application of a spacer element, said process comprising carrying out the centrifugation procedure resulting in fractionation of the sample using said centrifuge tube supplied with the functional elements, and then separating the specific liquid fractions entrapped in the inner spaces of the functional elements by removing said elements one by one from the common housing tube and taking out the liquid contents of said elements.

* * * * *